US006208819B1

(12) United States Patent
Pai et al.

(10) Patent No.: US 6,208,819 B1
(45) Date of Patent: Mar. 27, 2001

(54) METHOD FOR DISCHARGING PHOTORECEPTOR RESIDUAL CHARGES

(75) Inventors: Damodar M. Pai, Fairport; Moritz P. Wagner, Walworth; Neville R. Phillips, Rochester; Dennis A. Abramsohn, Pittsford; Jimmy E. Kelly, Rochester, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/457,598

(22) Filed: Dec. 7, 1999

(51) Int. Cl.[7] ..... G03G 21/00
(52) U.S. Cl. ..... 399/128; 399/129
(58) Field of Search ..... 399/128, 129, 399/123, 231, 343, 344

(56) References Cited

U.S. PATENT DOCUMENTS

| | | | | |
|---|---|---|---|---|
| 4,728,985 | | 3/1988 | Nakashima et al. | 355/7 |
| 4,804,999 | * | 2/1989 | Mueller | 399/129 |
| 5,394,230 | | 2/1995 | Kaukeinen et al. | 355/326 R |
| 5,748,221 | | 5/1998 | Castelli et al. | 347/232 |
| 5,848,335 | | 12/1998 | Folkins et al. | 399/186 |
| 5,933,177 | * | 8/1999 | Pollutro et al. | 399/123 |
| 6,047,155 | * | 4/2000 | Pietrowski et al. | 399/231 X |

OTHER PUBLICATIONS

Dennis A. Abramsohn et al., "Printing Machine with Reconditioning Light Source", U.S. Serial No.—(not yet assigned), Filed Dec. 7, 1999, (Attorney Docket No. D/99443).

* cited by examiner

*Primary Examiner*—Susan S. Y. Lee
*Assistant Examiner*—Hoan Tran
(74) *Attorney, Agent, or Firm*—Zosan S. Soong

(57) ABSTRACT

A method involving a photoreceptor having a front surface and a rear surface, including: (a) creating an electrostatic latent image on an image area of the photoreceptor front surface; (b) developing the latent image with developer particles to form a developed image; (c) transferring the developed image off the photoreceptor wherein the photoreceptor retains residual charges in the image area after the transferring of the developed image off the photoreceptor; and (d) discharging at least a portion of the residual charges in the image area, after transferring the developed image off the photoreceptor, by directing charge dissipation emissions at a portion of the image area and at a corresponding region on the photoreceptor rear surface directly opposite the image area portion.

7 Claims, 2 Drawing Sheets

METHOD FOR DISCHARGING PHOTORECEPTOR RESIDUAL CHARGES

FIELD OF THE INVENTION

This invention relates to a method for erasing residual electrostatic charge from a photoreceptor.

BACKGROUND OF THE INVENTION

Electrophotographic marking is a well known and commonly used method of copying or printing documents. Electrophotographic marking is performed by exposing a light image representation of a desired document onto a substantially uniformly charged photoreceptor. In response to that image the photoreceptor discharges so as to create an electrostatic latent image of the desired document on the photoreceptor's surface. Toner particles are then deposited onto that latent image so as to form a toner image. That toner image is then transferred from the photoreceptor onto a substrate such as a sheet of paper. The transferred toner image is then fused to the substrate, usually using heat and/or pressure. The surface of the photoreceptor is then cleaned of residual developing material and recharged in preparation for the production of another image.

The foregoing broadly describes a prototypical black and white electrophotographic printing machine. Electrophotographic marking can also produce color images by repeating the above process once for each color of toner that is used to make the composite color image. For example, in one color process, referred to herein as the REaD IOI process (Recharge, Expose, and Develop, Image On Image), a charged photoreceptive surface is exposed to a light image which represents a first color, say black. The resulting electrostatic latent image is then developed with black toner particles to produce a black toner image. The charge, expose, and develop process is repeated for a second color, say yellow, then for a third color, say magenta, and finally for a fourth color, say cyan. The various color toner particles are placed in superimposed registration such that a desired composite color image results. That composite color image is then transferred and fused onto a substrate.

The REaD IOI process can be implemented using a number of different architectures. For example, in a single pass printer a composite final image is produced in one pass of the photoreceptor through the machine. A second architecture is a four pass printer, wherein only one color toner image is produced during each pass of the photoreceptor through the machine and wherein the composite color image is transferred and fused during the fourth pass. REaD IOI can also be implemented in a five cycle printer, wherein only one color toner image is produced during each pass of the photoreceptor through the machine, but wherein the composite color image is transferred and fused during a fifth pass through the machine.

The single pass architecture is very fast, but expensive since four charging stations and four exposure stations are required. The four pass architecture is slower, since four passes of the photoreceptive surface are required, but also much cheaper since it only requires a single charging station and a single exposure station. Five cycle printing is even slower since five passes of the photoreceptive surface are required, but has the advantage that multiple uses can be made of various stations (such as using a charging station for transfer). Furthermore, five cycle printing also has the advantage of a smaller footprint. Finally, five cycle printing has a decided advantage in that no color image is produced in the same cycle as transfer, fusing, and cleaning when mechanical loads are placed on the drive system.

To erase residual electrostatic charge from the photoreceptor, conventional printing machines employ an erase source that either faces the image area on the front surface of the photoreceptor ("front erase") or faces the rear of the photoreceptor ("rear erase"). This conventional arrangement generally has been adequate for black and white reproductions and in color machines employing three or more pass architectures. The present inventors, however, have determined front erase or rear erase alone may be inadequate in certain situations for high quality color reproductions and especially for printing machines employing a single pass image on image architecture (with no erase after every development station). Using front erase or rear erase alone may create ghost images and slight voltage non-uniformities that result in objectionable color shifts. Thus, there is a need, which the present invention addresses for new erase methods.

Electrostatic charge erase apparatus and methods, as well as other parts of printing machines, are disclosed in Castelli et al., U.S. Pat. No. 5,748,221; Folkins et al., U.S. Pat. No. 5,848,335; Kaukeinen et al., U.S. Pat. No. 5,394,230; Nakashima et al., U.S. Pat. No. 4,728,985; and Pollutro et al., U.S. Pat. No. 5,933,177 (discloses the use of an ion stream to eliminate surface charge).

SUMMARY OF THE INVENTION

The present invention is accomplished in embodiments by providing a method involving a photoreceptor having a front surface and a rear surface, comprising:

(a) creating an electrostatic latent image on an image area of the photoreceptor front surface;

(b) developing the latent image with developer particles to form a developed image;

(c) transferring the developed image off the photoreceptor wherein the photoreceptor retains residual charges in the image area after the transferring of the developed image off the photoreceptor; and (d) discharging at least a portion of the residual charges in the image area, after transferring the developed image off the photoreceptor, by directing charge dissipation emissions at a portion of the image area and at a corresponding region on the photoreceptor rear surface directly opposite the image area portion.

In embodiments, the present method further comprising removing residual developer particles from the photoreceptor after the transferring the developed image off the photoreceptor, wherein the discharging of at least a portion of the residual charges in the image area occurs after the removing of the residual developer particles.

In addition, the electrostatic latent image preferably is a composite electrostatic latent image including a plurality of complementary latent images, wherein the developer particles includes a plurality of colors, wherein each complementary latent image is developed with the developer particles of a unique color.

BRIEF DESCRIPTION OF THE DRAWINGS

Other aspects of the present invention will become apparent as the following description proceeds and upon reference to the Figures which represent preferred embodiments.

Unless otherwise noted, the same reference numeral in different Figures refers to the same or similar feature.

DETAILED DESCRIPTION

Figure 1:
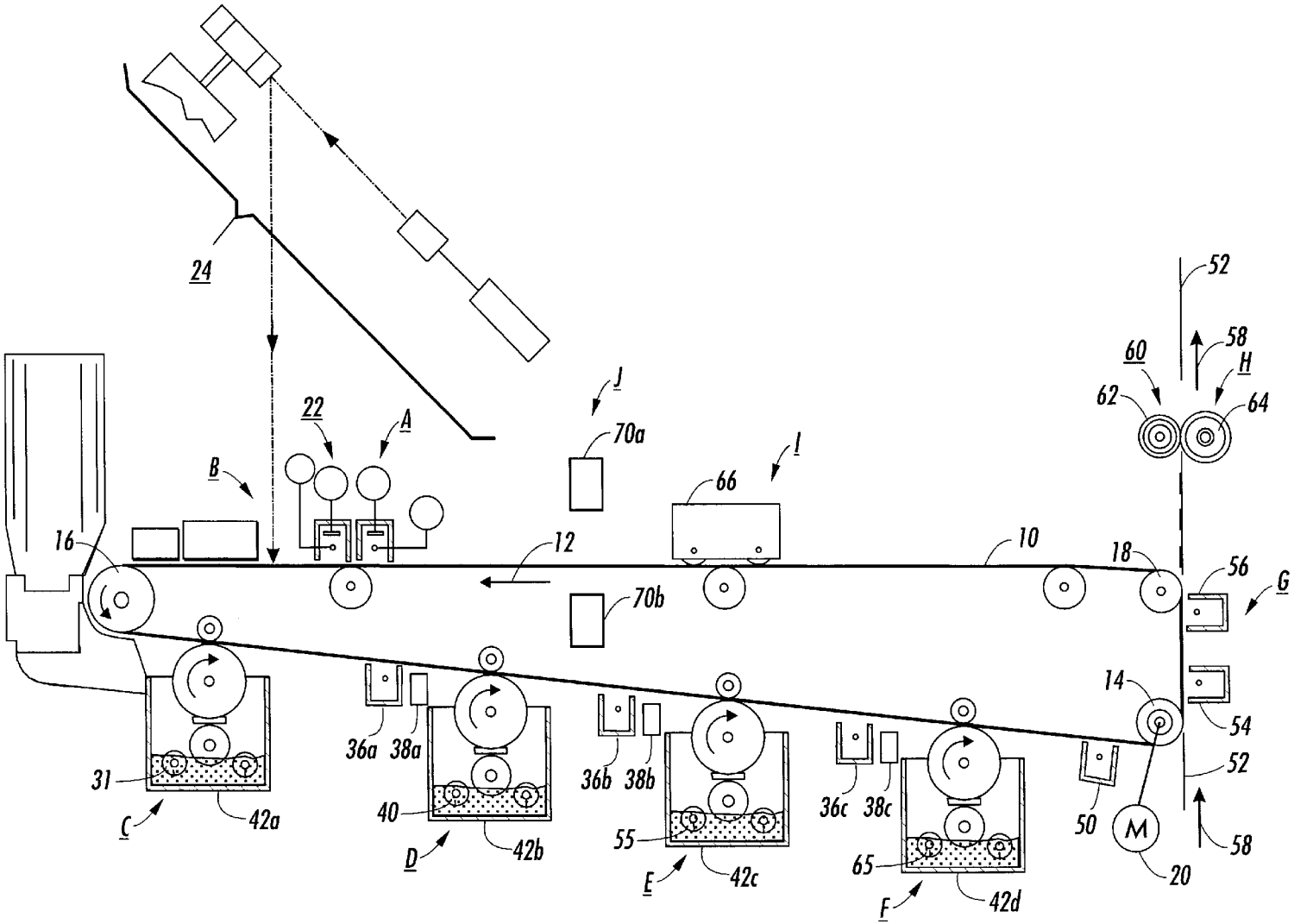
FIG. 1 is a schematic diagram of a four color printing machine according to one embodiment of the present invention.

Turning now to FIG. 1, the printing machine of the present invention uses a charge retentive surface in the form of an organic type photoreceptor belt 10 supported for movement in the direction indicated by arrow 12, for advancing sequentially through the various xerographic process stations. The belt is entrained about a drive roller 14, tension rollers 16 and fixed roller 18 and the roller 14 is operatively connected to a drive motor 20 for effecting movement of the belt through the xerographic stations.

As the photoreceptor belt travels, each part of it passes through each of the process stations described herein. For convenience, a single section of the photoreceptor belt, referred to as the image area, is identified. The image area is that part of the photoreceptor belt which is to receive the toner layer or layers which, after being transferred and fused to a substrate, produce the final color image. While the photoreceptor belt may have numerous image areas, since each image area is processed in the same way, a description of the processing of one image area suffices to fully explain the operation of the printing machine.

The image area, processing stations, belt travel, and cycles define two relative directions, upstream and downstream. A given processing station is downstream of a second processing station if, in a given cycle, the image area passes the given processing station after it passes the second processing station. Conversely, a given processing station is upstream of a second processing station if, in a given cycle, the image area passes the given processing station before it passes the second processing station.

An image area of belt 10 passes through charging station A where a corona generating device, indicated generally by the reference numeral 22, charges the photoconductive surface of belt 10 to a relative high, substantially uniform, preferably negative potential.

Next, the charged image area of photoconductive surface is advanced through an imaging or exposure station B. At exposure station B, the uniformly charged belt 10 is exposed to a laser based output scanning device 24 which causes the charge retentive surface to be discharged in accordance with the output from the scanning device. Preferably the scanning device is a laser Raster Output Scanner (ROS). Alternatively, the ROS could be replaced by other xerographic exposure devices such as LED arrays.

The photoreceptor, which is initially charged to a voltage $V_0$, undergoes dark decay to a level $V_{ddp}$ equal to about −500 volts. When exposed at the exposure station B with the maximum output level, it is discharged to $V_{background}$ equal to about −50 volts. Many levels of exposure between none and the maximum level can be used at station B to produce discharge levels at all voltages between $V_{ddp}$ and $V_{background}$. Thus after exposure, the photoreceptor contains a voltage profile of high to low voltages, the former corresponding to charged areas where one later wants untoned areas using discharged area development (DAD) and the latter corresponding to discharged or background areas where one later develops maximum amounts of toner. Voltage levels in between develop proportionally lesser amounts of toner.

At a first development station C, containing a developer housing structure 42*a*, developer particles 31 including toner particles of a first color such as black are conveyed from the developer housing structure 42*a* to develop the electrostatic latent image. Appropriate developer biasing is accomplished via power supply (not shown).

A corona recharge device 36*a* having a high output current versus control surface voltage (I/V) characteristic slope is employed for raising the voltage level of both the toned and untoned areas on the photoreceptor to a substantially uniform level. The recharging device 36*a* serves to recharge the photoreceptor to a predetermined level.

A second exposure or imaging device 38*a* which may comprise a laser based input and/or output structure is utilized for selectively discharging the photoreceptor on toned areas and/or bare areas, pursuant to the image to be developed with the second color developer. At this point, the photoreceptor contains toned and untoned areas at relatively high voltage levels and toned and untoned areas at relatively low voltage, levels. These low voltage areas represent image areas which are developed using DAD. To this end, a negatively charged, developer material 40 comprising color toner is employed. The toner, which by way of example may be yellow, is contained in a developer housing structure 42*b* disposed at a second developer station D and is presented to the latent images on the photoreceptor by a magnetic brush developer roller. A power supply (not shown) serves to electrically bias the developer structure to a level effective to develop the DAD image areas with negatively charged yellow toner particles 40.

The above procedure is repeated to deposit developer particles of a third color. A corona recharge device 36*b* having a high output current versus control surface voltage (I/V) characteristic slope is employed for raising the voltage level of both the toned and untoned areas on the photoreceptor to a substantially uniform level. The recharging device 36*b* serves to recharge the photoreceptor to a predetermined level.

A third exposure or imaging device 38*b* which may comprise a laser based input and/or output structure is utilized for selectively discharging the photoreceptor on toned areas and/or bare areas, pursuant to the image to be developed with the third color developer. At this point, the photoreceptor contains toned and untoned areas at relatively high voltage levels and toned and untoned areas at relatively low voltage, levels. These low voltage areas represent image areas which are developed using DAD. To this end, a negatively charged, developer material 55 comprising color toner is employed. The toner, which by way of example may be magenta, is contained in a developer housing structure 42*c* disposed at a developer station E and is presented to the latent images on the photoreceptor by a magnetic brush developer roller. A power supply (not shown) serves to electrically bias the developer structure to a level effective to develop the DAD image areas with negatively charged magenta toner particles 55.

The above procedure is repeated to deposit developer particles of a fourth color. A corona recharge device 36*c* having a high output current versus control surface voltage (I/V) characteristic slope is employed for raising the voltage level of both the toned and untoned areas on the photoreceptor to a substantially uniform level. The recharging device 36*c* serves to recharge the photoreceptor to a predetermined level.

A fourth exposure or imaging device 38*c* which may comprise a laser based input and/or output structure is utilized for selectively discharging the photoreceptor on toned areas and/or bare areas, pursuant to the image to be developed with the fourth color developer. At this point, the photoreceptor contains toned and untoned areas at relatively high voltage levels and toned and untoned areas at relatively low voltage, levels. These low voltage areas represent image areas which are developed using discharged area development (DAD). To this end, a negatively charged, developer material 65 comprising color toner is employed. The toner, which by way of example may be magenta, is contained in a developer housing structure 42*d* disposed at a developer station F and is presented to the latent images on the photoreceptor by a magnetic brush developer roller. A power supply (not shown) serves to electrically bias the developer structure to a level effective to develop the DAD image areas with negatively charged magenta toner particles 65.

Thus, in the manner described herein a full color composite toner image is developed on the photoreceptor belt.

To the extent to which some toner charge is totally neutralized, or the polarity reversed, thereby causing the composite image developed on the photoreceptor to consist of both positive and negative toner, a negative pre-transfer dicorotron member 50 is provided to condition the toner for effective transfer to a substrate using positive corona discharge.

Subsequent to image development a sheet of support material 52 is moved into contact with the toner images in direction 58 at transfer station G. The sheet of support material is advanced to transfer station G by conventional sheet feeding apparatus, not shown. Preferably, the sheet feeding apparatus includes a feed roll contacting the uppermost sheet of a stack of copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station G.

Transfer station G includes a transfer dicorotron 54 which sprays positive ions onto the backside of sheet 52. This attracts the negatively charged toner powder images from the belt 10 to sheet 52. A detack dicorotron 56 is provided for facilitating stripping of the sheets from the belt 10.

After transfer, the sheet continues to move, in the direction of arrow 58, onto a conveyor (not shown) which advances the sheet to fusing station H. Fusing station H includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52 after it is allowed to cool. After fusing, a chute, not shown, guides the advancing sheets 52 to a catch tray, not shown, for subsequent removal from the printing machine by the operator.

After the sheet of support material is separated from photoconductive surface of belt 10, the residual toner particles carried by both the image and non-image areas on the photoconductive surface are removed therefrom. These particles are removed at cleaning station I using a cleaning brush structure contained in a housing 66.

At erase station J, erase sources (front erase source 70*a*; rear erase source 70*b*) direct charge dissipation emissions at a portion of the image area (using 70*a*) and at a corresponding region on the photoreceptor rear surface (using 70*b*) directly opposite the image area portion subjected to the emissions of erase source 70*a*. Erase sources (70*a*,70*b*) discharge at least a portion of the residual charges in the image area, preferably to a residual voltage of below about 50 volts and preferably below about 25 volts, wherein the residual voltage after erase across the image area is preferably substantially uniform, with a range for example of up to plus or minus about 10 volts and preferably with a range of up to plus or minus about 5 volts. Each image area on the front surface of the photoreceptor as well as the corresponding regions on the photoreceptor rear surface undergoes exposure to erase sources (70*a*,70*b*).

The discharging of the residual charges in the image area may occur at any suitable moment in the xerographic process. For instance, erase station J could be positioned inside or outside the belt 10 at any position downstream of developer station F provided that sufficient charge dissipation emissions can reach the charge generation layer of the belt, for instance light emissions from the front of the belt at a wavelength to which the photoreceptor is sensitive but to which the developed toner layers are essentially transparent or translucent.

In embodiments, the charge dissipation emissions are directed simultaneously at the image area portion and the corresponding region on the rear surface. As seen in FIG. 1, this may be accomplished by positioning front erase source 70*a* and rear erase source 70*b* directly opposite from one another.

Figure 2:
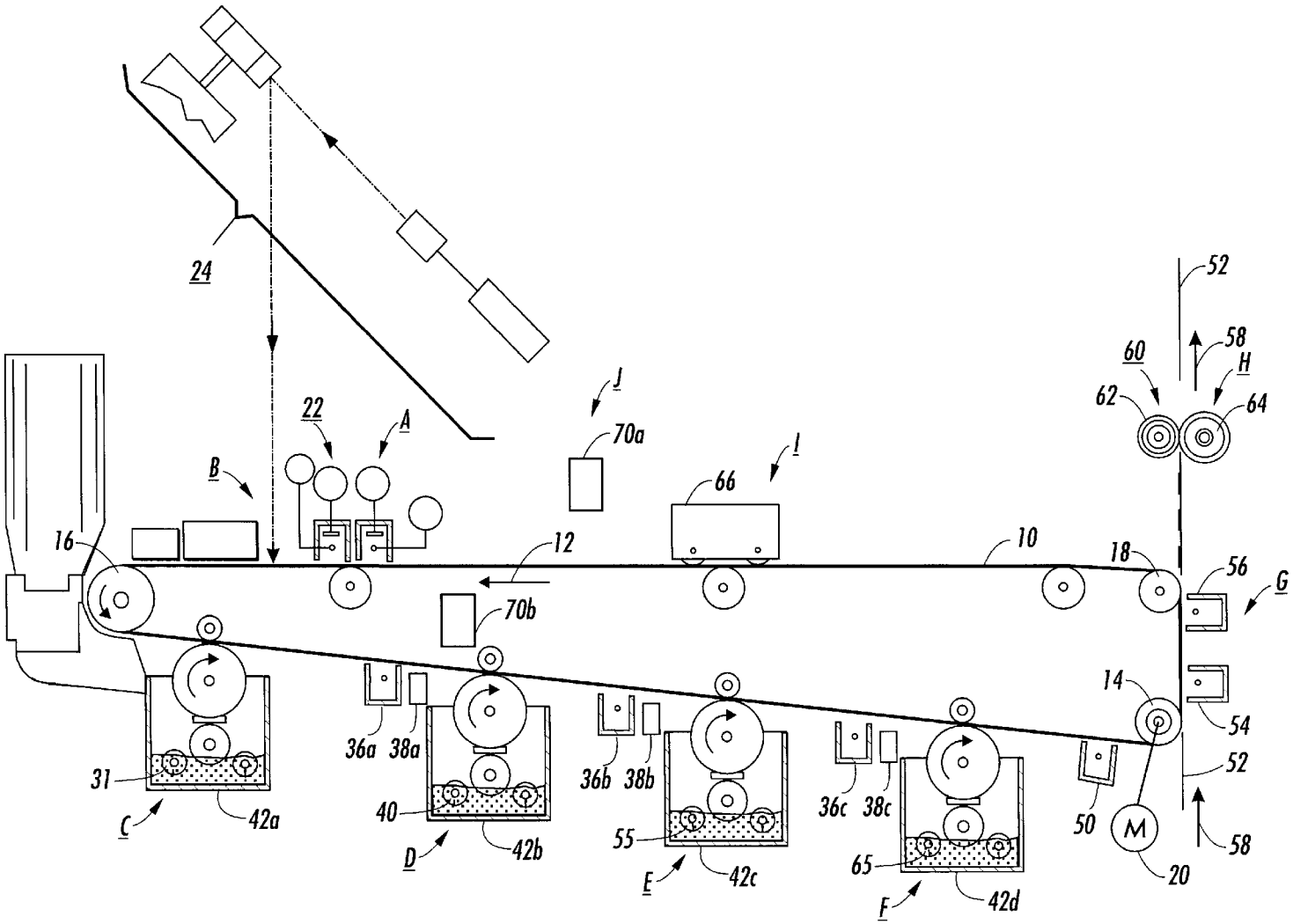
FIG. 2 is a schematic diagram of a four color image printing machine according to another embodiment of the present invention.

In other embodiments, the charge dissipation emissions are directed at the image area portion at a different time from the corresponding region on the rear surface. As seen in FIG. 2, this may be accomplished by positioning front erase source 70*a* upstream from the rear erase source 70b. Alternatively, front erase source 70*a* can be positioned downstream from the rear erase source 70*b*. The present erase process removes both charges remaining on the surface of the photoreceptor and charges located or trapped at various boundaries or within various layers of the photoreceptor. This removal can occur simultaneously or sequentially, with each erase device helping to eliminate charges left from the xerographic process and other charges remaining from the other erase device. The various intensities, wavelengths or ion penetration depths, can be chosen to maximize the removal of charges left by any part of the xerographic process or created by upstream or downstream erase devices.

The charge dissipation emissions may be light, ions, or both light and ions. Thus, front erase source 70*a* and rear erase source 70*b* both may be a light source (emitting same or different light wavelengths), or the front erase source may be a charge generating device while the rear erase source may be a light source. Suitable light sources include for example incandescent lamps such as tungsten lamps and halogen lamps, fluorescent lamps, neon lamps, light emitting diodes, and electroluminescent strips. Light may be employed by the erase sources at a single wavelength or a spectrum of wavelengths such as a broadband light source ranging for example from about 400 to about 800 nanometers but preferably in a range chosen to match the sensitivity of the charge generation layer of the photoreceptor or a narrowband light source (including a single wavelength light source) ranging for example of up to plus or minus about 10 nanometers around a peak wavelength chosen to generate charge in a specific location within the charge generation layer of the photoreceptor. It is specifically noted that using two erase sources of different wavelengths, different directions, and different energies eliminate more of the unwanted residual charges, wherever their location, than using either erase source alone.

The light exposure provided by each erase source (70*a*, 70*b*) for each image area ranges for example from about 10 to about 80 ergs/cm$^2$, preferably from about 20 to about 30 ergs/cm$^2$ at the charge generation layer of the photoreceptor. The light exposure provided by rear erase source 70*b* may be the same or different from that provided by the front erase source 70*a*.

Where the front erase source 70*a* emits ions, suitable charge generating devices include corotrons, scorotrons, dicorotrons, and the like. In embodiments, a corotron may be used such as a DC corotron with a charge opposite that of the photoreceptor charge. A DC scorotron with a electrically grounded screen separated from the photoreceptor surface by 1 to 4 mm and preferably 1 to 2 mm will cause the entire photoreceptor surface potential to reach a uniform residual voltage of substantially zero volts.

The present invention may be used with any conventional photoreceptor, including photoreceptors in the configuration of a sheet, a scroll, an endless flexible belt, a web, a cylinder, and the like.

Other modifications of the present invention may occur to those skilled in the art based upon a reading of the present disclosure and these modifications are intended to be included within the scope of the present invention.

We claim:

1. A method involving a photoreceptor having a front surface and a rear surface, comprising:

(a) creating an electrostatic latent image on an image area of the photoreceptor front surface;

(b) developing the latent image with developer particles to form a developed image;

(c) transferring the developed image off the photoreceptor wherein the photoreceptor retains residual charges in the image area after the transferring of the developed image off the photoreceptor; and (d) discharging at least a portion of the residual charges in the image area, after transferring the developed image off the photoreceptor, by directing charge dissipation emissions at a portion of the image area and at a corresponding region on the photoreceptor rear surface directly opposite the image area portion.

2. The method of claim 1, wherein the charge dissipation emissions are directed simultaneously at the image area portion and the corresponding region on the rear surface.

3. The method of claim 1, wherein the charge dissipation emissions are directed at the image area portion at a different time from the corresponding region on the rear surface.

4. The method of claim 1, wherein the charge dissipation emissions are light.

5. The method of claim 1, wherein the charge dissipation emissions are light and ions.

6. The method of claim 1, further comprising removing residual developer particles from the photoreceptor after the transferring the developed image off the photoreceptor, wherein the discharging of at least a portion of the residual charges in the image area occurs after the removing of the residual developer particles.

7. The method of claim 1, wherein the electrostatic latent image is a composite electrostatic latent image including a plurality of complementary latent images, wherein the developer particles includes a plurality of colors, wherein each complementary latent image is developed with the developer particles of a unique color.

* * * * *